United States Patent [19]

Lewis et al.

[11] 4,168,832

[45] Sep. 25, 1979

[54] SHEET JOGGING APPARATUS

[75] Inventors: Barry J. Lewis, Federal Way; Wade C. Vaughn, Seattle, both of Wash.

[73] Assignee: Norfin, Inc., Seattle, Wash.

[21] Appl. No.: 777,729

[22] Filed: Mar. 15, 1977

[51] Int. Cl.[2] ..... B65H 31/36

[52] U.S. Cl. ..... 271/221

[58] Field of Search ..... 271/221, 222

[56] References Cited

U.S. PATENT DOCUMENTS

| | | | |
|---|---|---|---|
| 1,421,868 | 7/1922 | Volkmere | 271/221 |
| 1,865,282 | 6/1932 | Smith | 271/221 |
| 2,265,617 | 12/1941 | Yates | 271/222 X |
| 3,022,999 | 2/1962 | Mead | 271/221 X |
| 3,627,312 | 12/1971 | Fackler | 271/221 |
| 3,658,324 | 4/1972 | Snellman | 271/222 |
| 3,944,217 | 3/1976 | Greene | 271/221 X |

*Primary Examiner*—Richard A. Schacher

*Attorney, Agent, or Firm*—Seed, Berry, Vernon & Baynham

[57] ABSTRACT

The apparatus includes a reciprocative side edge jogger for aligning the side edges of multiple sheet stacks in a column through movement with respect to the sheet side edges along a rectilinear path perpendicular thereto. The apparatus additionally includes a movable end edge jogger. The sheets are aligned against side and end edge backstops, which respectively oppose the side and end edge joggers. In one preferred embodiment, the side and end edge joggers are driven by a single motor. In a second preferred embodiment, the side and end edge joggers are driven by separate motors.

23 Claims, 9 Drawing Figures

FIG. 3
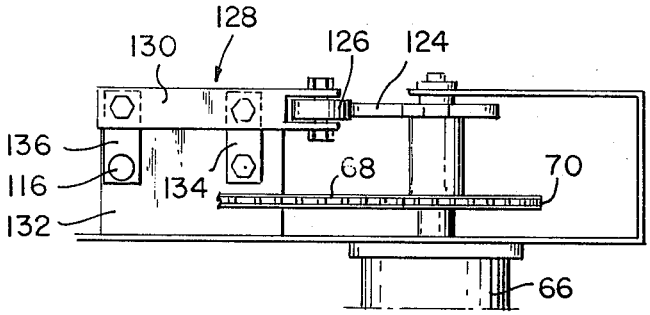
FIG. 4
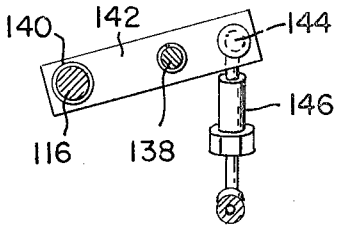
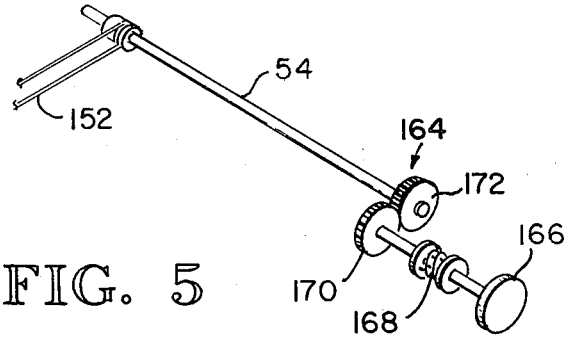
FIG. 5
FIG. 6
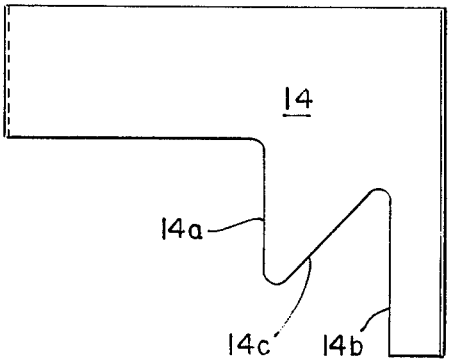
FIG. 7
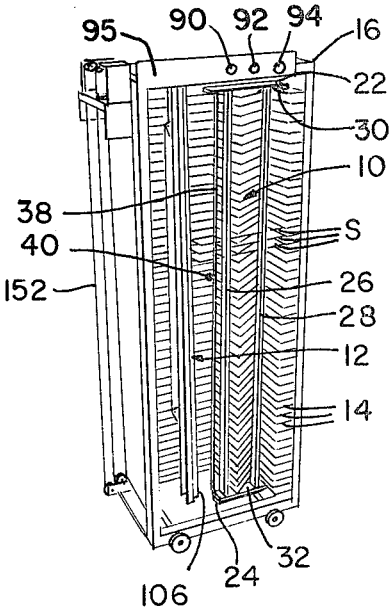

SHEET JOGGING APPARATUS

BACKGROUND OF THE INVENTION

This invention relates to sheet jogging apparatus.

Most prior sheet jogging apparatus includes side edge joggers which swing to and from a jogging position in simultaneous contact with the side edges of multiple sheet stacks within respective compartments of a bin column associated with a collator sheet receiver. These swing-type joggers typically are operated by relatively complex motor driven linkage assemblies which, in some practical applications, tend to lack versatility when handling or collating sheets of more than one size, or cause the sheets to be misaligned.

SUMMARY OF THE INVENTION

This invention overcomes or substantially mitigates these and other problems associated with prior sheet jogging apparatus by providing a reciprocative side edge jogger for aligning the side edges of multiple sheet stacks in a column through movement with respect to the sheet side edges along a rectilinear path perpendicular thereto. This invention additionally provides an end edge jogger. According to one preferred embodiment of the invention, the side and end edge joggers are driven by a single motor. According to a second preferred embodiment, the side and end edge joggers are driven by separate motors.

Thus, it will be appreciated from the foregoing summary that this invention provides simplified, yet highly versatile, sheet jogging apparatus which affords highly effective sheet jogging. While preferably the side and end sheet edges are aligned against respective side and end edge backstops, another generally similar side edge jogger could be substituted for the side edge backstop to accomplish side edge jogging. The terms "side edges" and "end edges" as used herein refer to the sheet edges adjacent the side and ends, respectively, of the sheet stack column or, in some applications, the sheet receiver. These terms are not intended to limit this invention to jogging sheets stacked in a particular orientation.

These and other features, objects and advantages of the present invention will become apparent from the detailed description and claims to follow taken in conjunction with the accompanying drawings in which like parts bear like reference numerals.

BRIEF DESCRIPTION OF THE INVENTION

FIG. 3 is a section taken along the line 3—3 in FIG. 1;

FIG. 4 is a section taken along the line 4—4 in FIG. 1;

FIG. 5 is a fragmentary perspective view of the sheet width control of the FIG. 1 apparatus;

FIG. 6 is a top plan view of one shelf of the FIG. 1 apparatus;

FIG. 7 is a perspective view of a sheet receiver equipped with the FIG. 1 apparatus;

DETAILED DESCRIPTION OF THE DRAWINGS

Figure 1:
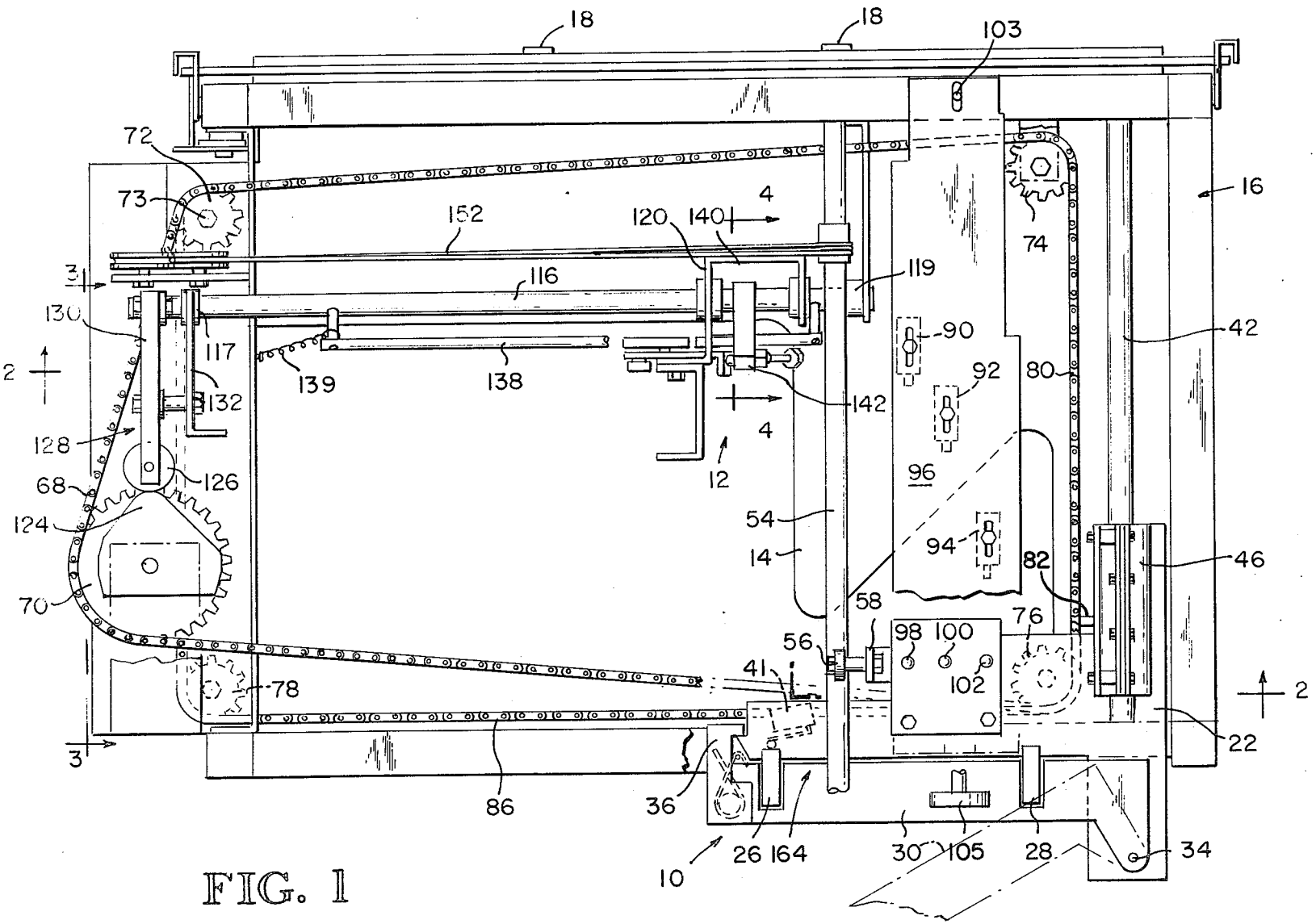
FIG. 1 is a top plan view of the sheet jogging apparatus of this invention with parts broken away.
Figure 2:
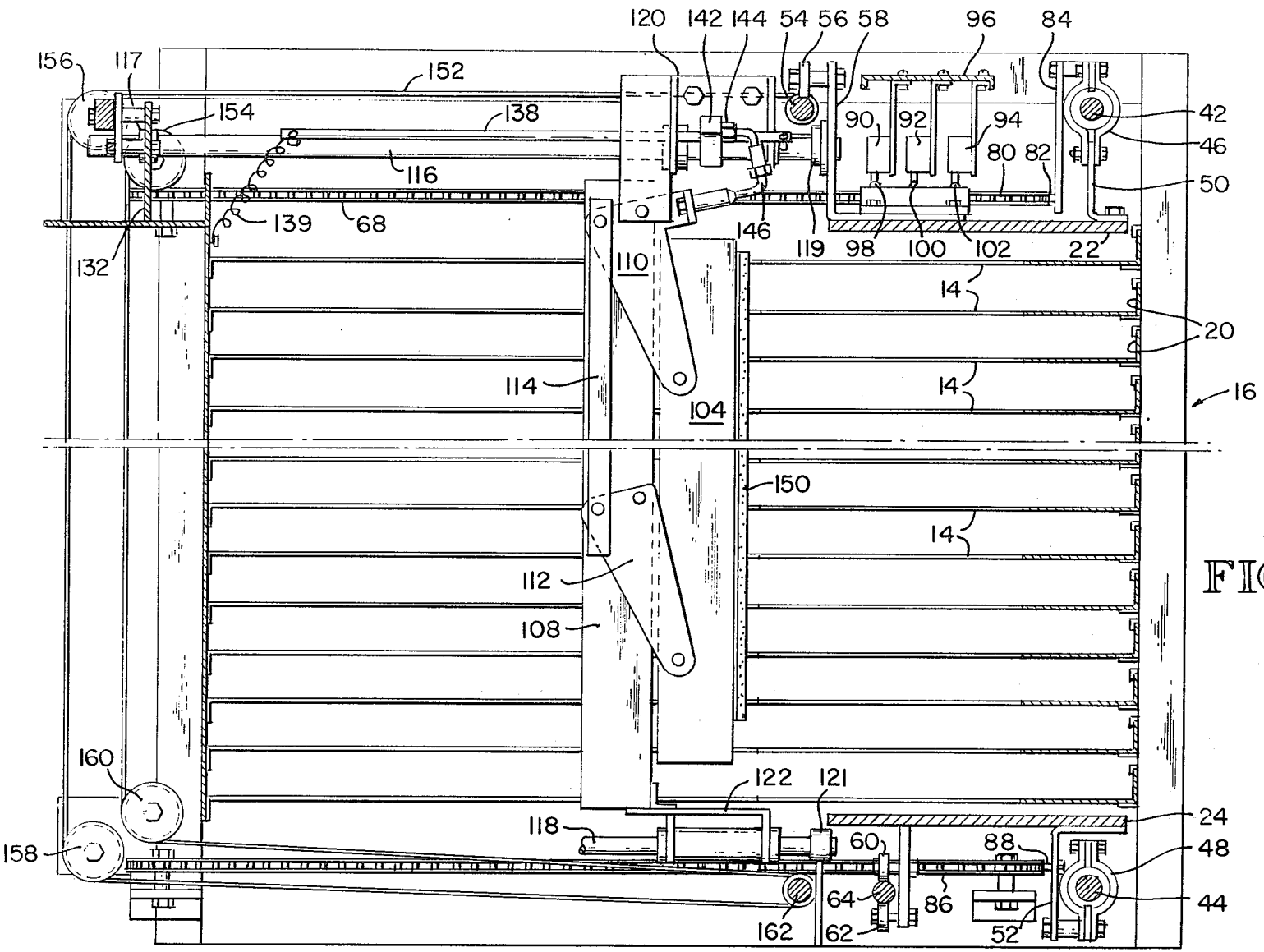
FIG. 2 is a section taken along the line 2—2 in FIG. 1.

The FIG. 7 sheet jogging apparatus of this invention includes an active side edge jogging assembly (generally referenced by numeral 10) and an active rear edge jogging assembly (generally referenced by numeral 12) for respectively engaging and applying jogging forces to the side and end edges of sheets stacked on shelves 14 within a vertical column of sheet receiving compartments or bins formed by a collator sheet receiver 16. In the illustrated example, respectively opposed passive backstops provide surfaces against which the opposite sheet edges are aligned during jogging. Referring to FIG. 1, backstops 18 are secured in vertical alignment to shelves 14 adjacent the opposite face of the receiver and provide side edge alignment. Backstops 20 are disposed in each bin as illustrated in FIG. 2 and provide end edge alignment. Sheets are distributed to the bins and are loosely stacked on shelves 14 by an appropriate sheet distributor, not shown.

SIDE EDGE JOGGER

The FIG. 7 side edge jogging assembly 10 includes upper and lower horizontal mounting members 22, 24. The inner ends of members 22, 24 are mounted by the receiver 16 for reciprocative movement along a rectilinear path perpendicular to the sheet side edges as will be described presently. A pair of parallel spaced apart side edge contact members or jogging bars 26, 28 of rectangular cross section are supported in vertical alignment between members 22, 24 by upper and lower support arms 30, 32. These arms are pivotally connected at their inner ends (right ends as illustrated in FIG. 7) from members 22, 24 by vertical pivot shafts 34 (FIG. 1) such that bars 26, 28 can be swung outwardly with respect to the bins as depicted in broken lines in FIG. 1 to permit sheet unloading. The outer ends of arms 30, 32 are secured by spring biased latches 36 to members 22, 24 and therefore move conjointly therewith, except when latches 36 are unlatched during sheet unloading. A vertical tube 38 is secured between the outer ends of arms 30, 32 and mounts a knob 40 intermediate its length. This knob can be grasped and pulled outwardly to swing the arms between their open and closed positions with latches 36 unlatched. An interlock switch 41 mounted on member 22 is operated when arm 30 is in its FIG. 1 closed position. This switch prevents operation of the apparatus when the arms are in their open position.

The aforementioned side edge jogging assembly 10 will now be described in further detail with specific reference to FIGS. 1–6 of the drawings. Referring first to FIGS. 1 and 2, members 22 and 24 are guided for reciprocative movement along a rectilinear path perpendicular to the sheet side edges by upper and lower transverse guide rods 42, 44. These rods are mounted by the receiver 16 in perpendicular alignment with the sheet side edges and are respectively connected to members 22, 24 by sleeve bearings 46, 48 and L-shaped plates 50, 52 secured to their inner ends (or the right ends as illustrated), as shown (FIG. 2). Bearings 46, 48 are movable reciprocatively along rods 42 and 44 respectively. The outer end (or left end as illustrated) of upper member 22 is further guided for corresponding movement by an intermediate upper shaft 54 which is connected to the receiver 16 in transverse alignment. This shaft is rotable about its longitudinal axis for purposes of sheet width adjustment as will be described presently. A roller 56 rides along the upper face of shaft 54 and is connected to the outer end of member 22 by L-flange 58. The corresponding end of lower member 24 is likewise guided by opposed rollers 60, 62 and intermediate lower transverse guide rod or track 64, as shown (FIG. 2).

A reversible motor 66 drives assembly 10 between a selected advanced jogging position (FIG. 7) and a retracted position (FIGS. 1 and 2). An endless upper chain 68 is trained about a drive sprocket 70 connected to motor 66, sprocket 72 connected to vertical jack shaft 73, and two idler sprockets 74, 76 all mounted by the receiver, as shown (FIG. 1). One run of this chain (this run referenced by numeral 80 in FIGS. 1 and 2) is adjacent and substantially parallel to rod 42. A pin 82 is secured to chain run 80 and in turn is connected by plate 84 to support 46, as shown (FIG. 2). Consequently, as chain run 80 is moved reciprocatively by appropriate operation of motor 66, assembly 10 and jogger bars 26, 28 are moved conjointly therewith along a rectilinear path perpendicular to the sheet side edges. An endless lower chain 86 is trained about three lower idler sprockets and one live sprocket, which are generally similar in construction and arrangement to sprockets 72, 74, 76, except that an additional idler sprocket 78 (FIG. 1) is substituted for drive sprocket 70. The lower live sprocket is attached to the lower end of and is driven by jack shaft 73. Chain 86 likewise is connected by pin 88 to plate 52. In the illustrated example, therefore, chain 86 is not driven directly by motor 66 but serves as a follower due to driving effort applied thereto by jack shaft 73.

To control the dispositions of the jogger bars at their advanced and retracted position with respect to sheet width, two or more position sensors may be provided for sensing jogger position and operating motor 66 accordingly. In the illustrated example, these sensors are constituted by three limit switches 90, 92, 94, which are mounted in underlying relation to a transverse channel 96 of generally inverted U-shaped cross section. This channel is mounted by the receiver in overlying relation to the path of movement of assembly 10. The switches 90, 92, 94 are respectively operated by spaced apart projections 98, 100, 102 upstanding from the horizontal base portion of flange 58. These switches are so positioned that they will be operated, respectively, when the jogger bars assume advanced jogging positions suited to jog sheets of predetermined width. In the example, switch 90 affords jogging of sheets 8 inches in width, switch 92 affords jogging of sheets 8½ inches in width, and switch 94 affords jogging of sheets 11 inches in width. Switches 90, 92 and 94 are activated alternatively by a width control 95 (FIG. 7). Thus, in each jogging cycle, motor 66 will advance the jogger bars to the advanced jogging position determined by the particular switch activated, depending upon the sheet width selected. In the illustrated example, a fourth limit switch (not shown) is operated at the retracted position of the jogger bars and causes motor 66 to be deenergized.

To provide fine adjustment of these positions, channel 96 is mounted so that it can be shifted transversely with respect to the longitudinal axis of the receiver 16. To this end, channel 96 is mounted at each end by slot-and-pin connections 103 (only one shown in FIG. 1). A manual width adjustment control 105 is connected between the receiver 16 and channel 96 by means not shown and serves to shift channel 96 in this manner. It will be recognized that additional switches and/or projections may be provided in order to position the jogger bars at additional locations and that the FIG. 1 sheet width control is therefore illustrative and not limiting.

Each shelf 14 has an outline which, in plan view (FIG. 6), accommodates the aforementioned movement of the jogger bars 26, 28. Referring to FIG. 6, each shelf includes two spaced apart rectilinear edges **14*a*, 14*b* in close clearance parallel alignment with the paths of movement of the jogger bars 26, 28. Each shelf further includes a generally diagonal edge 14*c* extending between edges 14*a*, 14*b*. In most practical cases involving standard size sheets, the illustrated shelf outline will cause the sheets S to be maintained flat within the respective receiver bins. In some instances involving sheet sizes of increased length, however, portions of the sheets will overlap edge 14*a*** and bend downwardly to some extent. In both cases, however, acceptable side edge jogging is obtained.

END EDGE JOGGER

The FIG. 7 end edge jogging assembly 12 includes a movable end edge contact member or jogger bar 104 (not shown in FIG. 7) and a sheet stop 106. (The sheet stop is not illustrated in the remaining figures.) In the illustrated example, sheet stop 106 is constituted by a rubber belt such as that disclosed in U.S. Pat. No. 3,598,401 assigned to the assignee of the present invention. This belt is mounted in vertical alignment and so positioned with respect to jogger bar 104 and the path of incoming sheets that it will engage and position the sheets on shelves 14 in appropriate disposition for subsequent end edge jogging by assembly 12.

Referring again to FIGS. 1 and 2, the end edge jogging assembly includes a channel 108 from which jogger bar 104 is supported in vertical alignment for reciprocative movement along an accurate path substantially perpendicular to the sheet end edges by upper and lower bell cranks 110, 112. A link 114 connects these cranks so that they swing bar 104 as a parallelogram linkage. The upper and lower ends of channel 108 are mounted by upper and lower longitudinal guide rods 116, 118 (FIG. 2). Rod 116 is rotatively supported at its ends by bushings 117, 119, which are mounted by the receiver, as shown (FIGS. 1 and 2). Rod 118 also is mounted at its ends by the receiver but is secured against rotative movement by set collar 121. An upper carriage 120 of generally U-shaped configuration rides along rod 116 and mounts the upper end of channel 108, as shown (FIGS. 1 and 2). A lower carriage 112 rides along rod 118 and likewise mounts the lower end of channel 108.

The aforementioned motor 66 also serves to drive the jogger bar 104. A cam 124 is secured to and rotated by the motor drive shaft. This cam engages a follower roller 126 associated with a rotary actuator assembly 128 for applying rotational effort to rod 116. As most clearly illustrated in FIG. 3, assembly 128 includes a follower arm 130 which is connected at one end (right end as illustrated) to roller 126 and is supported from plate 132 by link 134. (Plate 132 projects upward from the receiver and also serves as a support for the adjacent end of rod 116 via bushing 117.) The other end of arm 130 (left end as illustrated) is connected by a crank 136 to rod 116. Thus, as cam 124 is rotated by motor 66, roller 126 will follow the contour of cam 124 and, in so doing, will cause arm 130 to move rectilinearly about link 134. This motion is converted to rotational motion by crank 136 and is transmitted thereby to the end of rod 116.

Referring now to FIGS. 1, 2 and 4, a linkage assembly converts rotational movement of rod 116 to the aforementioned movement of the jogger bar 104. This assembly includes a pivot rod 138 which is secured at its ends to guide rod 116 in parallel alignment therewith as shown (FIG. 1). (As will be apparent hereinafter, the length of rod 138 is greater than the range of sheet length admustments desired.) A sleeve 140 is located between opposed flanges of carriage 120 (see FIG. 1) in sliding co-axial relation with rod 116. A link 142 is secured to and projects radially from sleeve 140 with rod 138 extending through it in transverse sliding relation, as shown (FIG. 4). A ball joint 144 connects the outer end of link 142 with crank 110 via an adjustable right angle connector 146. Thus, rotational movement of rod 116 appears as vertical rocking movement of link 142. The latter movement, when transmitted to crank 110, causes the jogger bar 104 to move to and from an advanced jogging position in contact with the rear end sheet edges. To minimize damage to the sheet edges, bar 104, or bars 26 and 28, or all such bars, may be provided with a suitable elongated cushion, as depicted by cushion 150 associated with bar 104 in FIG. 2.

To accommodate sheets of multiple lengths, a sheet length adjustment assembly may be provided for selectively positioning bar 104 along the longitudinal axis of the receiver. Referring to FIGS. 2 and 5 of the drawings, this assembly includes an endless cable 152, which is secured to carriages 120 and 122 for moving them conjointly along guide rods 116 and 118, respectively. Cable 152 is trained about appropriately positioned guide rollers 154, 156, 158, 160, shaft 54, and lower transverse shaft 162. Shaft 162 is supported with rod 118, as shown (FIG. 2). Shaft 54 is connected at one end with a sheet length adjustment mechanism 164. Referring to FIG. 5, this mechanism is made up of a control knob 166 and a suitable spring biased clutch 168 which, when engaged, transmits rotational effort to shaft 54 via spur gears 170, 172 for rotating shaft to a selected angular position. In so operating shaft 54 and clutch 168, a force is applied to carriages 120 and 122 via cable 152 which causes them to move bar 104 toward a selected position along the longitudinal axis of the receiver in accordance with sheet length. The aforementioned linkage assembly, for course, facilitates such movement of carriage 120 by virtue of the sliding relationship of sleeve 140 to rod 116, and of link 142 to rod 138. Shaft 54 is locked in a selected angular position corresponding to the selected disposition of bar 104 by disengaging clutch 168.

Figure 8:
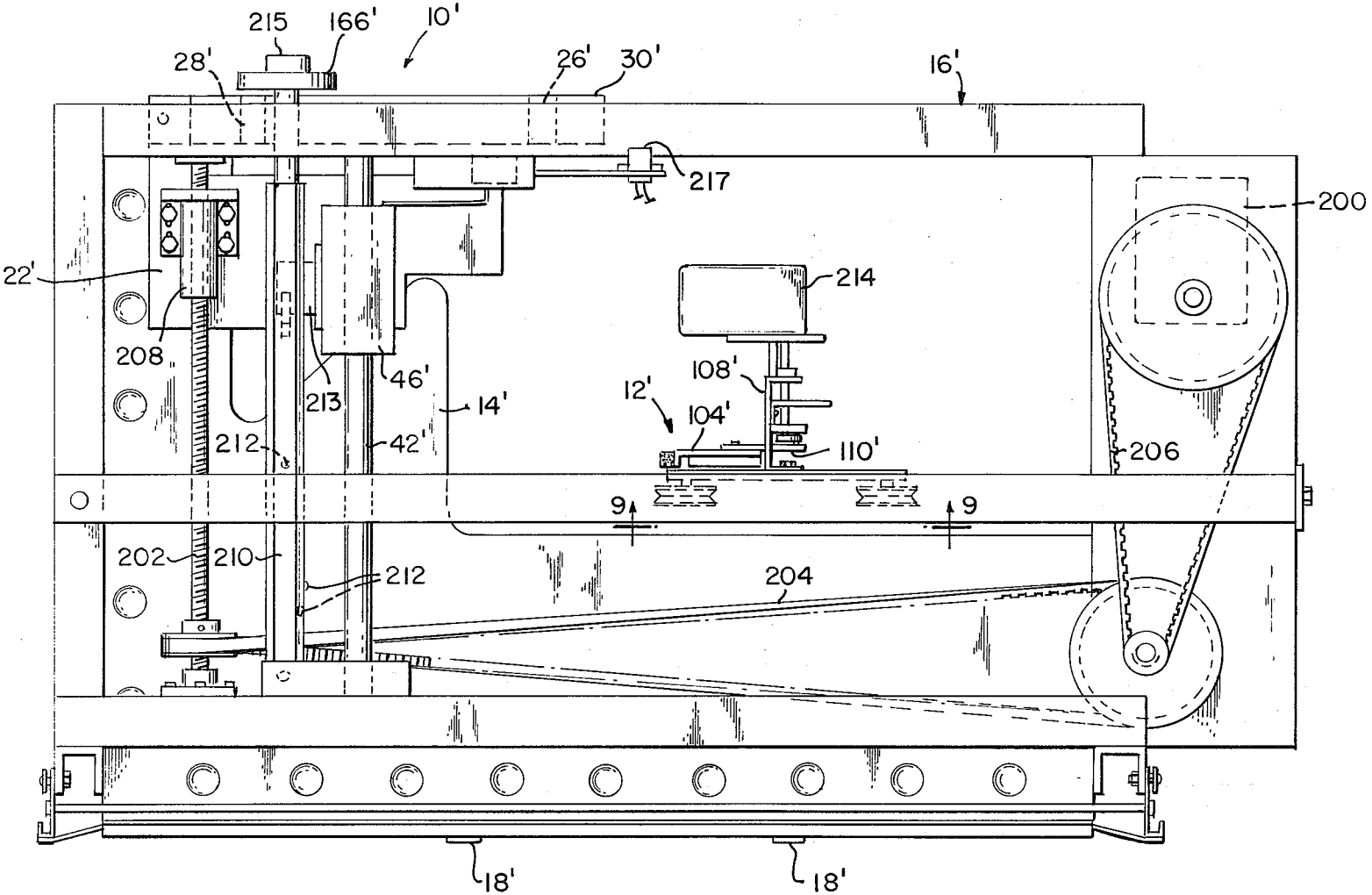
FIG. 8 is a top plan view of a second preferred embodiment of the sheet jogging apparatus of this invention.
Figure 9:
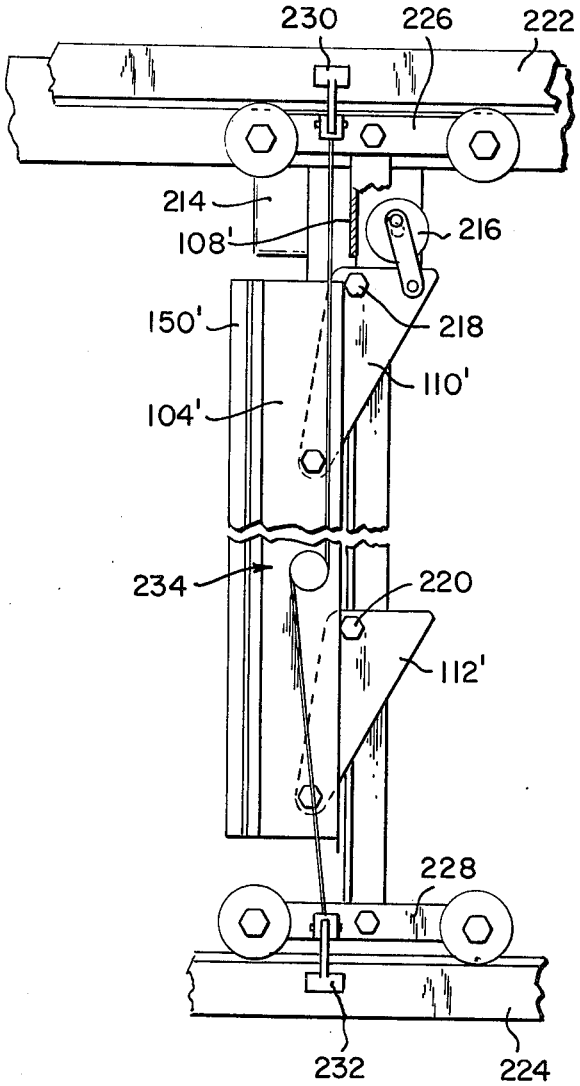
FIG. 9 is a section taken along the line 9—9 in FIG. 8.

A second preferred embodiment of the invention is illustrated in FIGS. 8 and 9 of the drawings in which like parts or assemblies are designated with the same reference numerals, primed. The FIGS. 8, 9 embodiment also accomplishes both side and end edge jogging of multiple sheet stacks within receiver 16', but employs separate motors to drive the side and edge jogging assemblies 10' and 12'.

Referring first to FIG. 8, the side edge jogging assembly 10' is driven by a motor 200, which applies rotational driving effort to a worm gear 202 via drive belts 204 and 206. Gear 202 is mounted rotatively at its ends by receiver 16'. A travelling nut 208 is threaded to and rides along gear 202 during rotation thereof by motor 200. This nut is secured to and moves the side edge jogging assembly 10' as described previously. The latter is generally similar to the FIGS. 1–7 side edge jogging assembly, except that the mounting and sheet width position control associated therewith are simplified by elimination of rod 54, roller 56, and the multiple switch-projection sheet width control.

The FIG. 8 sheet width control includes a control shaft 210 hexagonal in cross section and having projections 212 thereon at intervals corresponding to desired positions of assembly 10'. Shaft 210 is mounted rotatively by receiver 16' in overlying relation to the path of movement of assembly 10' so that projections 212 can be positioned selectively in overlying relation to that path in accordance with the rotational disposition of shaft 210. A sensor 213 mounted by member 22' senses projections 212 and effects appropriate control of motor 200. The shaft 210 is maintained in a selected rotational position by means not shown. A set-up control button 217 mounted from the receiver 16' may be provided for test-operating motor 200.

To provide fine adjustment of side edge jogger position, shaft 210 may be shifted transversely with respect to the longitudinal axis of the receiver 16'. To this end, a width adjustment control 215 is threaded to the outer end of shaft 210 and is so associated with the control knob 166' that shaft 210 may be shifted to and thereafter maintained in appropriate vertical alignment with the path of movement of assembly 10'.

The end edge jogging assembly 12' is driven by a motor 214. This motor applies rotational effort to eccentric wheel 216 (FIG. 9) which, in turn, causes cranks 110', 112' to rock vertically about pivots 218, 200, thereby moving jogger bar 104' between its advanced jogging position (shown in broken lines in FIG. 9) and its retracted position (shown in solid lines in FIG. 9).

For sheet length adjustment, assembly 12' is mounted for longitudinal movement with respect to and receiver and sheet end edges by upper and lower V-tracks 222, 224. Upper and lower carriages 226, 228 ride along these tracks, respectively, and maintain jogger bar 104' in vertical alignment. To selectively fix the position of carriages 226, 228 with respect to tracks 222, 224, suitable brakes may be provided for exerting braking effort between the tracks and carriages. In the illustrated example of FIG. 9, two such brakes are illustrated schematically at 230, 232.

Although two preferred embodiments of the invention have been illustrated and described herein, variations will become apparent to one of ordinary skill in the art. Accordingly, the invention is not to be limited to the specific embodiments illustrated and described herein, and the true scope and spirit of the invention are to be determined by reference to the appended claims.

The embodiments of the invention in which an exclusive property or privilege is claimed are defined as follows:

1. Sheet jogging apparatus comprising: side edge jogging means including movable side edge contact means for simultaneously aligning the side edges of multiple sheet stacks in a column; means for moving said side edge contact means toward and away from the sheet stacks along a rectilinear path perpendicular to the sheet side edges, said means for moving said side edge contact means including support means for supporting said side edge contact means, and mounting means mounting said support means for reciprocative movement along said path; means connecting said side edge contact means and said support means such that said side edge contact means may be moved with respect to said support means from an operative position underlying said support means toward a sheet unloading position in which said side edge contact means avert from said support means and the sheet side edges; and means acting between said side edge contact means and said support means for selectively maintaining said side edge contact means and said support means in their operative position.

2. The apparatus of claim 1, further comprising means for sensing whether said side edge contact means are in their operative position, and preventing operation of said side edge jogging means until said side edge contact means resume their operative position.

3. The apparatus of claim 1, wherein said side edge jogging means further include means opposed to said side edge contact means for providing a fixed backstop against which the sheets may be aligned by said side edge contact means.

4. The apparatus of claim 1, further comprising end edge jogging means for simultaneously aligning the end edges of said sheet stacks.

5. The apparatus of claim 4, wherein said end edge jogging means include movable end edge contact means, and wherein said means for moving said side edge contact means are further operative for moving said end edge contact means along an arcuate path substantially perpendicular to the sheet end edges.

6. The apparatus of claim 5, further comprising means for selectively positioning said end edge contact means with respect to the sheet end edges, and wherein said means for moving said side and end edge contact means include a single motor mounted at a location spaced from said side and end edge contact means, means connecting said motor to said side edge contact means, and means for adjustably connecting said motor to said end edge contact means while permitting such selective positioning thereof.

7. The apparatus of claim 5, wherein said end edge jogging means further include sheet stop means mounted adjacent said end edge contact means for engaging and positioning the sheets in multiple stacks in a column.

8. The apparatus of claim 4, wherein said end edge jogging means include movable end edge contact means, and means for moving said end edge contact means independently of said side edge contact means.

9. The apparatus of claim 8, further comprising means for selectively positioning said end edge contact means with respect to the end edges of said sheet stacks, and wherein said means for moving said side edge contact means include a first motor, and means, and wherein said means for moving said end edge contact means include a second motor mounted adjacent said end edge contact means, and means connecting said second motor to said end edge contact means.

10. The apparatus of claim 8, wherein said end edge jogging means further include sheet stop means mounted adjacent said end edge contact means for engaging and positioning the sheets in multiple stacks in a column.

11. Sheet jogging apparatus comprising: side edge jogging means including movable side edge contact means for simultaneously aligning the side edges of multiple sheet stacks in a column; and means for moving said side edge contact means toward and away from the sheet stacks along a rectilinear path perpendicular to the sheet side edges; said means for moving said side edge contact means including support means operatively connected with said side edge contact means for supporting said side edge contact means, and mounting means mounting said support means for reciprocative movement along said path; said side edge jogging means further including control means responsive to the position of said support means for controlling the disposition of said side edge contact means with respect to the sheet stacks.

12. The apparatus of claim 11, wherein said control means include a plurality of operator members upstanding from said support means, sensor means including individual position sensors located at predetermined locations in overlying relation with said path for respectively sensing said operator members, and means for selectively activating said position sensors so as to sense selected operator members.

13. The apparatus of claim 12, further comprising means for adjusting the location of said position sensors with respect to said path.

14. The apparatus of claim 11, wherein said control means include an elongated control member mounted in overlying relation to said path for selective adjustment in a direction parallel thereto, sensor means projecting from said control member at predetermined locations for selective positioning relative to said path depending on the disposition of said control member, and operator members mounted by said support means for contacting a selected sensor means overlying said path.

15. The apparatus of clam 14, further comprising means for adjusting the disposition of said control member with respect to said path.

16. The apparatus of claim 1, wherein said control means includes an elongated control member mounted in overlying relation to said path for selective adjustment in a direction parallel thereto, sensor means projecting from said control member at predetermined locations for selective positioning relative to said path depending on the disposition of said control member, and operator members mounted by said support means for contacting a selected sensor means overlying said path.

17. Sheet jogging apparatus, comprising:

side edge jogging means including movable side edge contact means for simultaneously aligning the side edges of multiple sheet stacks in a column;

end edge jogging means including movable end edge contact means for simultaneously aligning the end edges of the sheet stacks; and means operatively connected to said side edge contact means and said end edge contact means for moving (1) said side edge contact means reciprocatively with respect to the sheet stacks along a rectilinear path perpendicular to the sheet side edges, and (2) said end edge contact means reciprocatively with respect to the sheet stacks along an arcuate path substantially perpendicular to the sheet end edges;

said side edge jogging means further including control means responsive to the position of said side edge contact means for controlling the disposition of said side edge contact means with respect to the sheet stacks, said control means including a plurality of operator members mounted for conjoint movement with said side edge contact means, sensor means including individual position sensors located at predetermined locations in overlying relation with said rectilinear path for respectively sensing said operator members, and means for selectively activating said position sensors so as to sense selected operator members.

18. The apparatus of claim 17, further comprising means for adjusting the location of said position sensors with respect to said path.

19. Sheet jogging apparatus, comprising:

side edge jogging means including movable side edge contact means for simultaneously aligning the side edges of multiple sheet stacks in a column;

end edge jogging means including movable end edge contact means for simultaneously aligning the end edges of the sheet stacks;

means operatively connected to said side edge contact means for moving said side edge contact means reciprocatively with respect to the sheet stacks along a rectilinear path perpendicular to the sheet side edges; and means operatively connected to said end edge contact means for moving said end edge contact means reciprocatively with respect to the sheet stacks along an arcuate path substantially perpendicular to the sheet end edges;

said side edge jogging means further including control means responsive to the position of said side edge contact means for controlling the disposition of said side edge contact means with respect to the sheet stacks, said control means including an elongated control member mounted in overlying relation to said rectilinear path for selective adjustment in a direction parallel thereto, sensor means projecting from said control member at predetermined locations for selective positioning relative to said rectilinear path depending on the disposition of said control member, and means mounted for conjoint movement with said side edge contact means for contacting a selected sensor means overlying said path.

20. The apparatus of claim 19, further comprising means for adjusting the disposition of said control member with respect to said path.

21. In combination with a sheet receiving bin having means for forming a plurality of uniform sheet stacks in a column; side edge jogging means operatively associated with said bin and including movable side edge contact means for simultaneously aligning the side edges of sheets in said stacks, and means for moving said side edge contact means toward and away from the sheet stacks along a rectilinear path perpendicular to the sheet side edges to thereby align said sheets, said means for moving said side edge contact means including support means operatively connected with said side edge contact means for supporting said side edge contact means, said side edge jogging means further including control means responsive to the position of said support means for controlling the disposition of said side edge contact means with respect to the sheet stacks to thereby accommodate sheets of various widths.

22. The combination according to claim 21, wherein said control means include an elongated control member mounted in overlying relation to said path for selective rotational movement about its longitudinal axis, operator members projecting from said control member at predetermined locations for selective positioning in overlying relation to said path in relation to the rotational disposition of said control member, and means mounted by said support means for sensing a selected operator member overlying said path.

23. Sheet jogging apparatus, comprising: side edge jogging means including movable side edge contact means for simultaneously aligning the side edges of multiple sheet stacks in a column;

end edge jogging means including movable end edge contact means for simultaneously aligning the end edges of the sheet stacks;

means operatively connected to said side edge contact means for moving said side edge contact means reciprocatively with respect to the sheet stacks along a rectilinear path perpendicular to the sheet side edges;

means operatively connected to said end edge contact means for moving said end edge contact means reciprocatively with respect to the sheet stacks along an arcuate path substantially perpendicular to the sheet end edges;

said side edge jogging means further including control means responsive to the position of said side edge contact means for controlling the disposition of said side edge contact means with respect to the sheet stacks, said control means including an elongated control member mounted in overlying relation to said path for selective rotational movement about its longitudinal axis, operator members projecting from said control member at predetermined locations for selective positioning in overlying relation to said path in relation to the rotational disposition of said control member, and means mounted for conjoint movement with said side edge contact means for sending a selected operator member overlying said path.

* * * * *